United States Patent [19]

Cutri

[11] 4,257,599

[45] Mar. 24, 1981

[54] SOCCER GAME TO BE PLAYED WITH MANUALLY MOVABLE PLAYER PIECES

[76] Inventor: Juan M. Cutri, 1312 Lovell Ave., Arcadia, Calif. 91006

[21] Appl. No.: 82,107

[22] Filed: Oct. 5, 1979

[51] Int. Cl.[3] ..... A63F 7/07

[52] U.S. Cl. ..... 273/85 R

[58] Field of Search ..... 273/85 R, 126 R, 126 A

[56] References Cited

U.S. PATENT DOCUMENTS

| | | | |
|---|---|---|---|
| 2,152,882 | 4/1939 | Engel | 273/85 R X |
| 3,811,677 | 5/1974 | Saladrigas | 273/85 R X |

FOREIGN PATENT DOCUMENTS

| | | | |
|---|---|---|---|
| 886683 | 7/1943 | France | 273/85 R |
| 150166 | 9/1920 | United Kingdom | 273/85 R |
| 292176 | 6/1928 | United Kingdom | 273/85 R |
| 341651 | 1/1931 | United Kingdom | 273/85R |
| 486047 | 5/1938 | United Kingdom | 273/85 R |
| 594720 | 11/1947 | United Kingdom | 273/85 R |

*Primary Examiner*—Paul E. Shapiro

*Attorney, Agent, or Firm*—William W. Haefliger

[57] ABSTRACT

A soccer game to be manually played on a table comprises:

(a) a table top representative of a soccer field, (b) generally disc shaped sliders representative of soccer players, the sliders positioned on the table top to slide therealong in response to finger flicking force application, and (c) a missile representative of a soccer ball, the missile having multiple sides and edges so that when struck by a moving slider, the missile will tumble in a generally linear direction and come to rest as a result of repeatedly striking the table top, the missile positioned on the table top.

6 Claims, 9 Drawing Figures

SOCCER GAME TO BE PLAYED WITH MANUALLY MOVABLE PLAYER PIECES

BACKGROUND OF THE INVENTION

This invention relates generally to table top games, and more particularly concerns a table top soccer type game.

The sport of soccer, while popular outside the United States, has recently gained greater popularity in the U.S. However, it is costly to attend, and the spectators do not actively participate. There is and has been a long standing need for a recreational game similar to soccer, and characterized in that everyone can participate by virtue of exercise of skill.

SUMMARY OF THE INVENTION

It is a major object of the invention to meet the above need through the provision of a table top game which, through novel players pieces and other equipment, including a player board, enable manual play of soccer. Basically the game comprises, in combination:

(a) a table top representative of a soccer field, (b) generally disc shaped sliders representative of soccer players, the sliders adapted to slide along the table top in response to finger flicking force application, and (c) a missile representative of a soccer ball, the missile having multiple sides and edges so that when struck by a moving slider, the missile will tumble in a generally linear direction and come to rest as a result of repeatedly striking the table top.

As will be seen, each slider has mass and density substantially in excess of the mass and density of the missile, and the latter preferably has cube or cubical shape with side flats, and edges, to cause the missile to tumble and move in a manner similar to a soccer ball, but without rolling off the table top. Further, goal pockets or nets are provided on the table top, and other sliders extend upright in front of those pockets to define goal tenders. Such other sliders have table top engaging peripheral surfaces (which are normal to the opposite flat sides of the sliders) and may be formed as peripheral flats. Thus, such goal tending sliders may be knocked over by player sliders so as to allow travel of the missile into the pockets, during play; at the same time, the other sliders have the general shape of the player sliders.

The above elements are particularly well adapted to the play of table top soccer, as will be clear from a description of the rules and principles of game play.

These and other objects and advantages of the invention, as well as the details of an illustrative embodiment, will be more fully understood from the following specification and drawings, in which:

DRAWING DESCRIPTION

DETAILED DESCRIPTION

Figure 1:
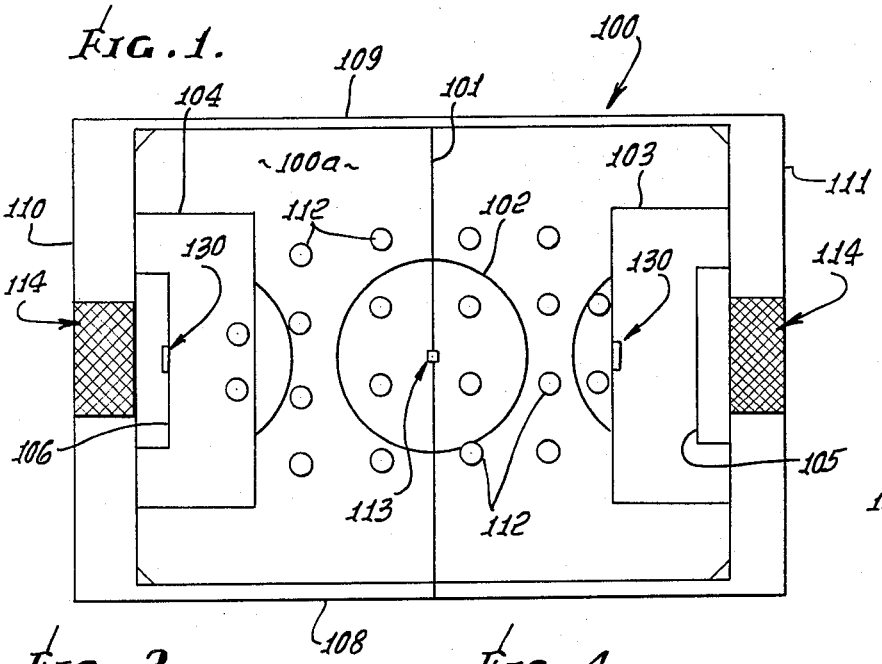
FIG. 1 is a plan view of a table top or board showing a soccer game field.
Figure 6:
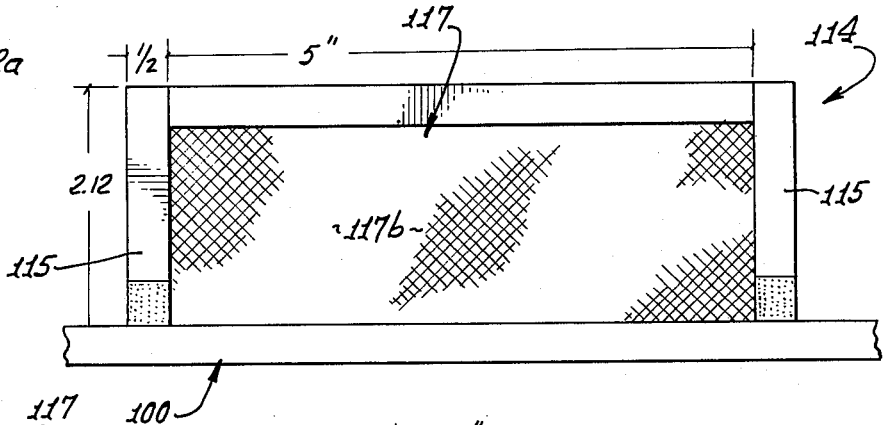
FIG. 6 is an enlarged frontal view of a pocket as used on the FIG. 1 board.
Figure 7:
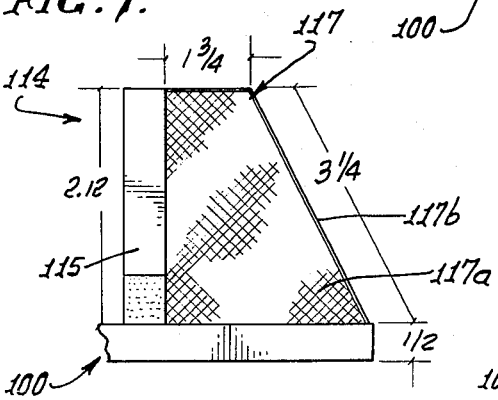
FIG. 7 is an end view of the FIG. 6 pocket.

In FIGS. 1, 6 and 7 a table is shown at 100, with its top surface 100*a* bearing lines 101–107 representative of soccer field lines or stripes. The edges of the table appear at 108–111. Edges 108 and 109 may be 48 inches long, and edges 110 and 111 may be 32 inches long. Other dimensions may be as shown in the various figures, although the invention is not limited to specific dimensions.

Generally disc shaped sliders 112 are shown arrayed on the table top in beginning positions, although other positions may be taken. The sliders are preferably in the form of checkers, are circular in outline, and may consist of wood, plastic or other material; however, wood is preferably due to its frictional development on the wooden table top as the sliders slide along the surface in response to finger impact as by sharp flicking force application. They typically are colored to designate different teams. and bear player numbers. Nationally known teams may be so represented. The top and bottom surfaces 112*a* and 112*b* of each slider are parallel and flat, and each slider has a cylindrical outer surface 112*c*.

Figure 5:
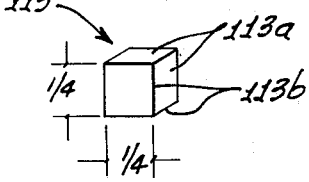
FIG. 5 is a perspective view of a missile to be struck by the sliders.
Figure 3:
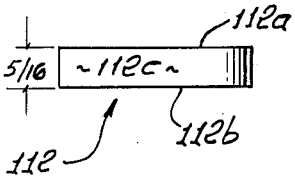
FIG. 3 is an elevation view of the FIG. 2 slider.

FIGS. 1 and 5 show a relatively lightweight missile 113 representative of a soccer ball. The missile has multiple slides (as at 113*a*) and edges (as at 113*b*) so that when struck by a moving slider, the missile will move in a path usually at an angle to the slider's linear direction of movement, whereby great skill is required to direct the slider at the missile so that the missile will move in the general direction of the goal, as it tumbles along the board surface, repeatedly striking same, and other sliders in its path. The missile is preferably cubical, is made of substantially less dense material than the sliders so that upon impact with a striking slider, the missile will tend to move to greater extent than the impacting slider moved, and the striking slider will not be substantially deflected from its path. Thus, each slider has mass substantially in excess of the mass of the cubical missile. A typical missile consists of balsa wood.

Figure 8:
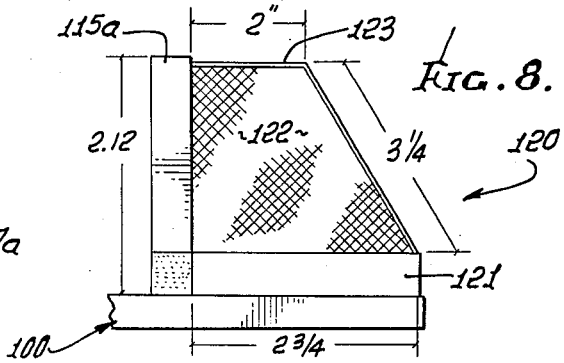
FIG. 8 is a view of a modified pocket.

Also provided are pockets or net structures, as at 114, spaced endwise of the table top and facing one another to represent soccer goal nets. As shown, each structure 114 includes two laterally spaced uprights 115, a cross-piece 116 interconnecting the tops of the uprights, and a self standing net 117 with sides 117*a* and back-piece 117*b* attached to the members 115 and 116. The structure 114 may be attached to the table top, as by suitable fasteners or a bonding agent, or they may simple be placed down on the table top to be movable. The modified goal structure 120 seen in FIG. 8 has lower side members 121 attached to uprights 115*a*, so as to provide good support to the table top, structure 120 being movable about on the table top. The net 122 may be suitably reinforced, as by wires 123 attached to posts 115*a* and members 121, as shown.

Finally, other sliders are located in front of the pockets to represent goal tenders. As shown, such other sliders 130 extend upright to define planes generally normal to the plane of the table top. Those sliders 130 have table top engaging local peripheral or edge surfaces 131, formed for example by cutting a sector off a disc shaped slider. Thus, the flat bottom surface 131 subtends an angle $\alpha$ of between 90° and 170° as respects the center of the otherwise circular slider 130. Note circular periphery 131*a*.

Figure 4:
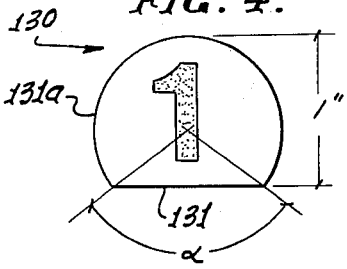
FIG. 4 is an elevational view of a goal tender piece.

It will be seen from th drawings (as in FIGS. 4 and 5) that the maximum upright dimension of the other slider 130 (1 inch in FIG. 4) is at least twice the length of each edge of the missile 113, aiding the play as described above and below.

The game is played as per the following instructions:

CHECKERS OR DISCS

The "players" of each team are represented by colored wooden checkers or discs to differentiate from the other team, and they will "run" thru the "field" (table) and "kick" when a player flicks his checkers in a flipping motion with either the thumb or index finger. This flicking movement is the key in deploying "players" successfully. There are eleven colored checkers on each team, one checker being the goalkeeper. One can "dress up" his checkers with the circle labels included. In today's soccer, numbers on the shirt means nothing, players have specific duties and one can do the same with "players".

THE FIELD

The table soccer field as shown in the drawing has the following markings:

(a) The goal
(b) Goal area
(c) Penalty area
(d) Penalty mark
(e) Penalty arc or semicircle
(f) Center circle
(g) Center spot
(h) Center line
(i) Side line
(j) Corner area Note: In the United States, every field has two lines parallel to the center line from side line to side line. These two lines are unnecessary and they aren't regulated by FIFA.

One can place the table 100 over another table, ping-pong table, pool table or on the floor, in order to play.

THE GOALS

The two goals are a very important part of the game and should be kept in good condition.

THE BALL

The "ball" 113 is cubical, the reasons being: (1) so that the "ball" never will roll and fall from the field, constantly, (2) so that the players can use every edge to give a different direction to the"ball". A checker can hit the ball in the right edge and the ball will go to the left side of the goal or vice-versa. When one hits the ball right or left edges, the ball should always go to the opposite side.

The CHECKERS' POSITION

One can set his "checkers" in any strategic position, but some checkers should be "defense" and others checkers should be "offense". In table soccer there exist two positions: One at kick-off and the other following (a) the first out of bounds after kick-off or (b) in any goal attempt. In those instances one may re-position both offensive and defensive checkers in any strategic position. Other cases of re-position any ones teams after the kick-off are: a foul committed or "using hands". Two additional offensive positions are M and W shaped.

THE START OF PLAY

Every checker must be in its own half of the field, and checkers of the opposite team that will not kick-off must be outside of the center circle. The team that will take the kick-off has to move the ball forward two consecutive times, one with a checker and the second kick with a different checker. In both instances one cannot attempt to score a goal. After the two opening "kicks" (or moves) the opponent takes his turn for a single move and each side subsequently take turns for another single move. At any time, when the ball crosses the center line, the player can attempt a goal, but he must say "GO" prior to the attempt. At that time the other player can place in any appropriate position the goalkeeper, always inside of the "goal area". The word "GO" is mandatory everytime a goal is attempted, otherwise the goal is void. In such an event the defensive team is awarded with a free-kick from the "penalty area". Example: "Go with number 10". A goal cannot be attempted if the ball is touching the center line. The ball must be completely past the center line in order to attempt a goal.

If the ball touches or passes either: (1) the goal-lines or (2) the touch-lines, the ball is "out". When the ball is "out" the other team will re-start the game with a throw-in by flicking the ball with any checker. A throw-in goal is voided. However, the checker initially performing the throw-in can subsequently "kick" the ball once it is touched thru a flicking move by any opposing checker, but not before, if the same checker kicks the ball twice. Otherwise, a free-kick is awarded from the approximate spot of the violation, to the other team. The reason for this rule is to avoid a short flick through a throw-in and scoring of a goal with the same checker. A throw-in must be a pass to another checker. Such an event is called "technical mistake".

THE BALL OUT OF PLAY

In some cases two opposing checkers may have the ball "frozen" between them. The checker that last "touches" the ball before it goes out of bounds loses possession. Sometimes it could be difficult to determine who touches the ball last, but both persons playing will decide it in common agreement. A throw-in or goal-kick is necessary to re-start the game.

REFEREE

Table soccer doesn't need a referee because the two persons playing can officiate as referees in common agreement, but if a third person is present, he or she can officiate as referee and keep the time for the players.

OFF-SIDE

Table soccer does not have an off-side.

FOULS

Figure 9:
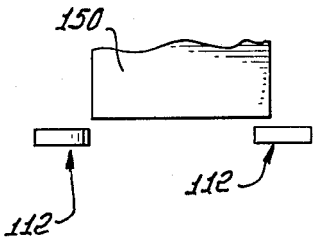
FIG. 9 shows a measurement.
Figure 2:
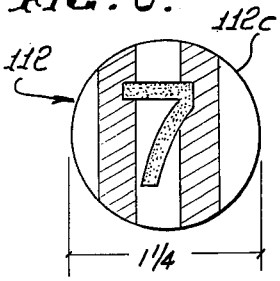
FIG. 2 is a plan view of a slider to be used as a game player on the FIG. 1 board.

A foul occurs when a checker pushes an opposing checker more than three inches without the ball between them. To determine such violation, the two persons or referee will use the checkers' box as a device to measure the gap between the two checkers. The short side of the box is the "ruler" to determine a foul. The fouled team is then awarded with a free-kick. If the foul occurs in the opponent's territory a goal can be attempted. The defensive team has the option to form a "wall" with several checkers to block the goal. The ball will be placed approximately where the foul occured and the "wall" will be formed from at least 6 inches from the ball. To measure the distance between ball and wall, use the longest side of checkers' box. If a foul is committed within the penalty area, a penalty kick is awarded. See box 150 "measurement" of players, in FIG. 9.

THE PENALTY KICK

The penalty kick is a dramatic moment in table soccer. The participants are the checker that will kick and the goalkeeper of the other team. The person that will kick the penalty kick must first place the ball over the penalty mark and the checker; then it's time for the other person to set his goalkeeper on the goal line. All other checkers (both teams) must be set in any place behind the penalty circle.

In table soccer nobody can foul the goalkeeper, i.e. it can be pushed as far as one wants in any instance. In the penalty kick, the foul rule changes in relation to the goalkeeper. The checker that will "kick" the penalty cannot touch the goalkeeper. If the checker touches the goalkeeper it is a foul against the goalkeeper and the goal is voided. A free kick is awarded to the goalkeeper's team, and any checker can kick the ball from the goal area.

If the goalkeeper stops the penalty kick, and the ball goes beyond the goal area, because the goalkeeper touches the ball, the goalkeeper can flick the ball to any place in the field. The goalkeeper's flick is very different from the regular flick motion. Remember that the goalkeeper is the only checker that stands up.

GOALKEEPER'S FLICK

A goalkeeper's flick can be accomplished holding the goalkeeper checker between thumb and forefinger with a twist of wrist, flicking the ball in the desired direction. In any attempt on the goal, including the penalty kick, which is blocked by the goalkeeper that deflects outside of the goal area but inside the penalty area, the goalkeeper may flick in the designated manner.

If the goalkeeper blocks any attempt to score, including a penalty kick, and the ball goes beyond the penalty area, the game continues between the checkers of both teams in the positions that they are in. The goalkeeper can flick the ball inside of two areas: the goal area and the penalty area, as was explained.

GOALKEEPER'S FLICK TO THE SIDES

The players can move the ball with the goalkeeper as a short "goalkeeper's flick" to the sides of the goal area, but no more than three times. This move is good when the goalkeeper blocks the ball in an attempt of goal from the other team and the goal and/or penalty area is crowded with checkers of both teams. The rule of a single move by both players applies here, counting the goalkeeper's flick to the side as one single move. The goalkeeper can be set in any place around goal posts or goal area when it is not acting.

MOVING MORE THAN ONE CHECKER

If two or more checkers of one team are together as result of a "wall" formation, the player can move those checkers with a single flicking move.

CHECKERS INSIDE OF THE GOALS

When a checker moves inside of the goal as result of a goal attempt, its correct position is on the goal line. This is a mandatory free move, immediately after that checker moves inside of the goal.

HANDS

Any ball landing on top of any checker is considered "using hands" and a free kick is award to the opposing team. If such "hands" occurs inside of the penalty area, a penalty kick is awarded.

EJECTIONS

There are no ejections in table soccer.

THE GAME'S DURATION

Two equal halves of 15 minutes are played, plus any extra time for any delay. Teams exchange sides after half time.

SCORING GOALS

A goal is scored when the ball completely crosses the goal line between the posts. A ball touching the goal line between the posts is not a goal. After scoring a goal all checkers are re-positioned in their starting positions, i.e. in a kick-off formation.

GOAL KICKS

On goal kicks the ball may be kicked from anywhere along the goal line but must be placed behind the penalty arc line. If the ball goes out from the left side, the goal kick must be made from the left side, or vice-versa.

CORNER KICKS

On corner kicks there are two options:

(1) A direct goalkick to attempt a goal (Preceeded by the mandatory "go").

(2) Or, a pass.

The ball must be placed inside the corner circle or touching the circle.

PLAY ON/ADVANTAGE

A player can ignore a foul made on one of his checkers if he considers that he has a good position to attempt a goal.

I claim:

1. In a soccer game to be manually played on a table, the combination comprising (a) a table top representative of a soccer field, (b) generally disc shaped sliders representative of soccer players, the sliders positioned on the table top to slide therealong in response to finger flicking force application, (c) a missile representative of a soccer ball, the missile being generally in cube form and having multiple sides and edges so that when struck by a moving slider, the missile will tumble in a generally linear direction and come to rest as a result of repeatedly striking the table top, the missile positioned on the table top, (d) each slider having density and mass substantially in excess of the density and mass of the missile, and (e) pockets on and spaced endwise of the table top and facing toward one another to represent soccer goal nets, there being multiple of such player sliders located on the table top, and other sliders in front of said pockets to represent goal tenders, said other sliders extending upright to higher level than said missile, said other sliders being partially disc shaped and having flat peripheral surfaces engaging the table top, the flat peripheral surface of each of said other sliders intersecting the disc shaped surface of the slider, the overall length of that flat surface subtending an angle of between about 90° and 170° as respects the center of the otherwise circular slider.

2. The combination of claim 1 wherein the sliders include two like groups, the sliders of one group having a first colored indicia on the flat sides thereof, and the sliders of the other group having a second colored indicia on the flat sides thereof.

3. The combination of claim 1 wherein said pockets are slidably carried by the table top.

4. The combination of claim 1 wherein said pockets are attached to the table top.

5. The combination of claim 1 wherein the sliders are cylindrical, and have opposite flat sides.

6. The combination of claim 1 including sufficient of said disc shaped sliders placed on the table top to represent two opposing soccer teams, the game to be played as described in the foregoing description.

* * * * *